US005417334A

United States Patent [19]

Wu

[11] Patent Number: 5,417,334

[45] Date of Patent: May 23, 1995

[54] GOLF CLUB RACK

[75] Inventor: Fang-Li Wu, Tainan Hsien, Taiwan, Prov. of China

[73] Assignee: Sports World Enterprise Co., Ltd., Tainan Hsien, Taiwan, Prov. of China

[21] Appl. No.: 156,740

[22] Filed: Nov. 24, 1993

[51] Int. Cl.[6] ..... A47F 7/00

[52] U.S. Cl. ..... 211/70.2; 206/315.2; 211/14; 248/156

[58] Field of Search ..... 211/70.2, 14; 248/96, 248/156, 530, 532; 273/32 E; 206/315.2, 315.6, 315.7

[56] References Cited

U.S. PATENT DOCUMENTS

| | | | |
|---|---|---|---|
| 699,391 | 5/1902 | Johnson | 211/70.2 |
| 1,621,329 | 3/1927 | Malone | 211/70.2 |
| 1,731,755 | 10/1929 | Snow et al. | 248/96 |
| 2,024,484 | 12/1935 | Smith | 248/96 X |
| 2,577,333 | 12/1951 | Klum et al. | 211/70.2 |
| 3,465,993 | 9/1969 | Muehlhausen | 248/96 |
| 3,666,221 | 5/1972 | Schilz | 248/96 X |
| 3,866,646 | 2/1975 | Nevard | 206/315.2 X |

*Primary Examiner*—Robert W. Gibson, Jr.

*Attorney, Agent, or Firm*—Morton J. Rosenberg; David I. Klein

[57] ABSTRACT

A golf club rack includes an elongate rod, an extensible rod extensibly provided in a lower end portion of the elongate rod to be pulled out thereof to insert in the ground to secure the club rack on the ground for use, a support base having a plurality of club holes for the tops of golf clubs to fit therein, a locating disc fixed firmly on the upper portion of the elongate rod and having club holes and a notch formed by a long and a short projection extending outward from each club hole for the lower slender portion of a club to slide therein for holding golf clubs, and a bent section provided in the elongate rod for a ball holder to by fixed beside the section for keeping balls therein, and a carrying band fixed on the elongate rod for carrying this rack on a shoulder.

3 Claims, 2 Drawing Sheets

GOLF CLUB RACK

BACKGROUND OF THE INVENTION

Golf has become very popular in many countries, as players enjoy sunny grounds like green and wide fields. Several golf clubs are necessary for playing it in various ways of striking a ball, commonly golf club bags and club carts are used for carrying golf clubs around a wide golf ground.

SUMMARY OF THE INVENTION

This invention has been devised to offer a kind of gold club rack portable on a shoulder or with a hand and possible to be set temporarily on the ground by an extensible rod inserted in the ground.

The golf club rack in the present invention includes an elongate rod, a support base fixed on a lower portion of the elongate rod and having club holes for upper ends of golf clubs to insert upside down and be supported therein, a locating disc made of elastic material fixed firmly on an upper portion of the elongate rod and having club holes around its outer circumference and a notch formed by a short and a long projection extending outward from each club hole for a slender lower portion .of a golf club to slide and fit therein upside down by force, and a disc to rest on the ground fixed at the bottom.

An extensible rod is provided to extend in a lower portion of the elongate rod, and a bolt is fixed sidewise at top of the extensible rod, extending out of the wall of the elongate rod to fit and move up and down by hand in a lengthwise guide slot in the elongate slot. A coil spring is provided to fit around the extensible rod and in the elongate rod to recover the extensible rod back to its place after it is pushed down and the guide slot has a hook-shaped bottom end for the bolt to be hooked at to stop the extensible rod for inserting the lower portion of the extensible rod in the ground for securing the rack on the ground temporarily for use.

The elongate rod also has a bent section in the upper portion down the locating disc and a ball holder made of elastic material and having ball holes is fixed beside the bent section for keeping golf balls therein.

A carrying band is provided to be fixed with the elongate rod for carrying this rack on a shoulder, or the bent section of the elongate rod can be held by hand for carrying.

BRIEF DESCRIPTION OF DRAWINGS

The invention will be better understood by reference to the accompanying drawings, wherein.

DESCRIPTION OF THE PREFERRED EMBODIMENTS

Figure 1:
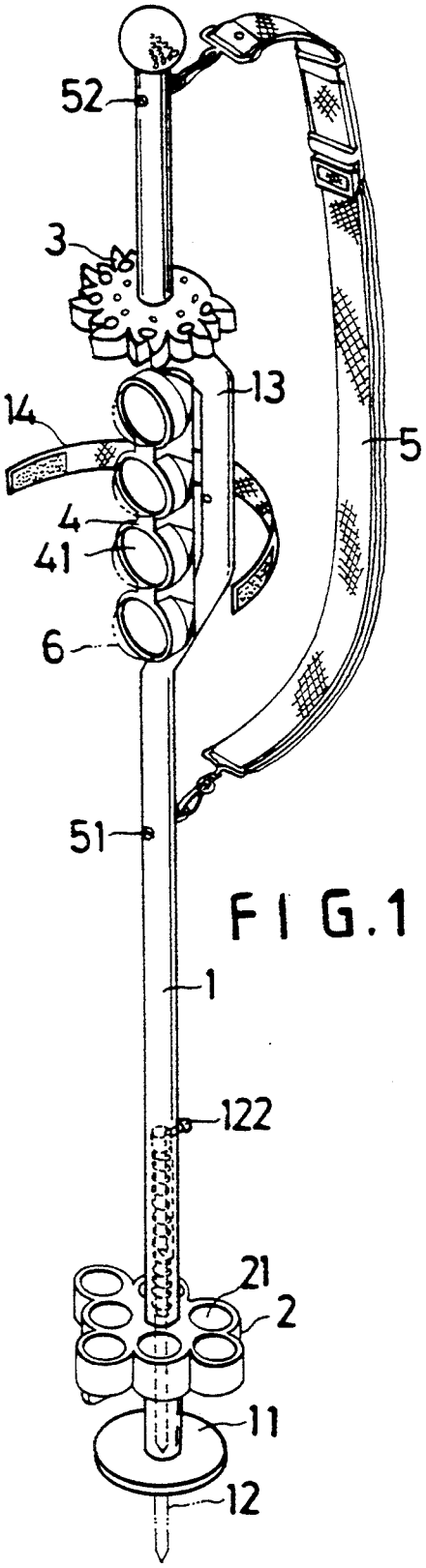
FIG. 1 is a perspective view of a golf club rack in the present invention.

A golf club rack in the present invention, as shown in FIG. 1, includes an elongate rod 1, a support base 2, a locating disc 3, a ball holder 4, and a carrying band 5 assembled together.

Figure 4:
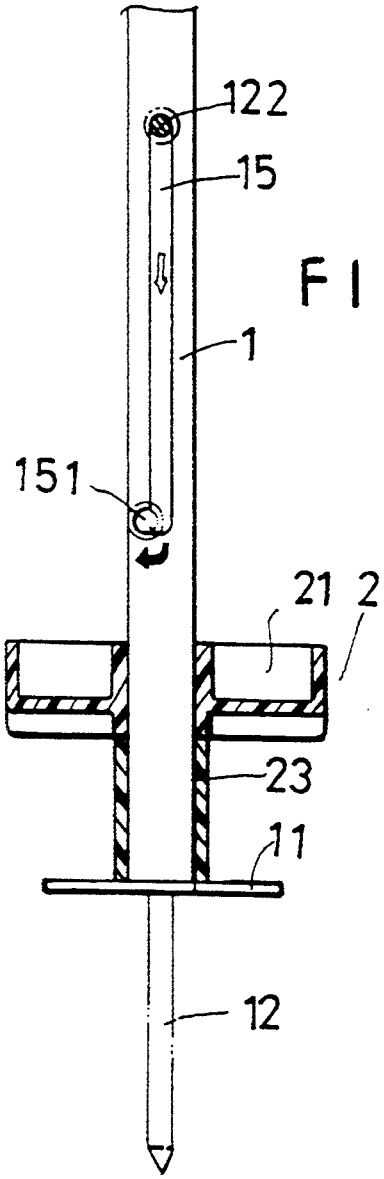
FIG. 4 is a part cross-sectional view of the golf club rack in the present invention; and, FIG. 5 is a cross-sectional view of FIG. 4.
Figure 5:
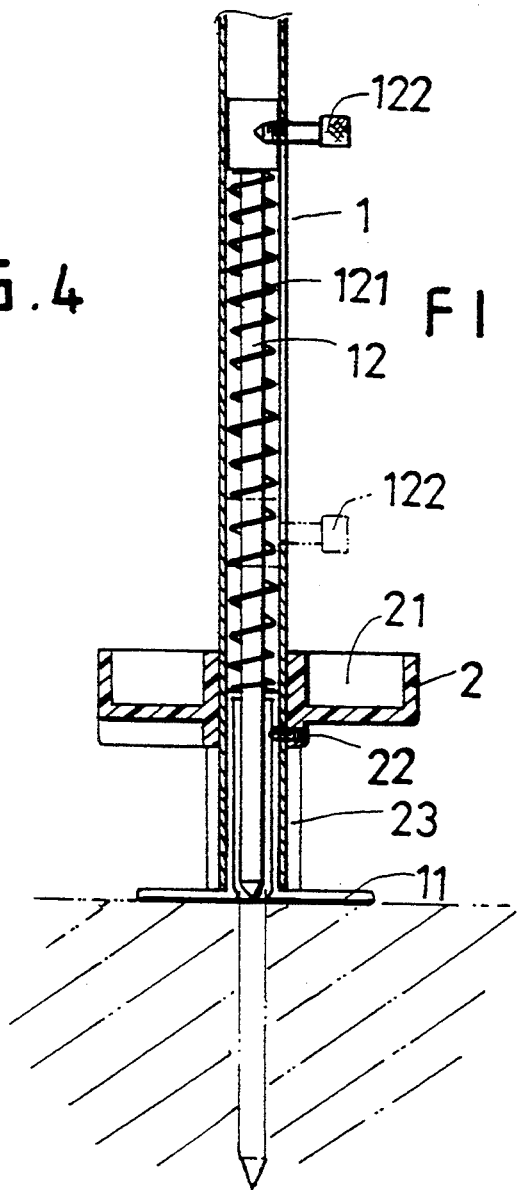

The elongate rod 1 has a round plate at bottom, a bent section 13 in an upper portion, a binding band 14 fixed on the bent section. An extensible rod 12 as shown in FIGS. 4 and 5 is provided in a lower portion of the elongate rod 1 and a coil spring 121 fits around the rod 12 to recover the extensible rod 12 back to its place after the extensible rod 12 is pulled down, and a bolt 122 is fixed at top of the extensible rod 12 and protruded the wall of the elongate rod 1, extending also in a lengthwise guide slot 15 in the elongate rod 1. The guide slot 15 has a hook-shaped bottom end 151 so that the bolt 15 can be hooked at the bottom end 151, securing the rack on the ground when the extensible rod 12 is pressed down to extend out of the bottom of the elongate rod 1.

The support base 2 is made of a proper material, having a plurality of club holes 21 for the top ends of golf clubs to insert therein upside down, fixed firmly on a lower portion of the elongate rod 1 above the round plate 11 by means of a screw 22 and a sleeve tube 23 fitting around the rod 1 under the support base 2, as shown in FIGS. 4 and 5.

Figure 3:
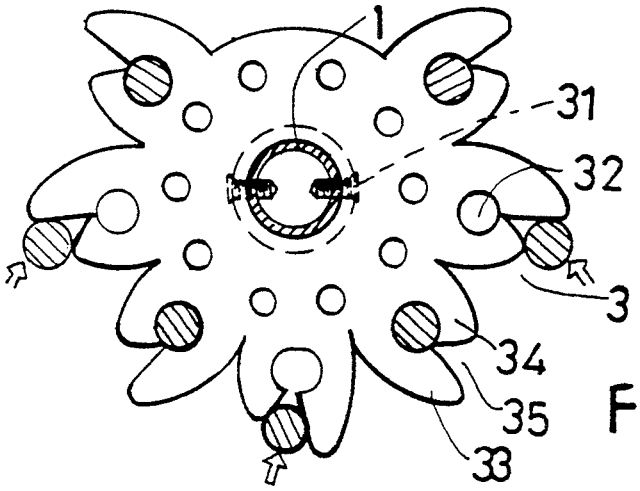
FIG. 3 is an upper view of a locating disc of the golf club rack in the present invention.

The locating disc 3 is made of a kind of elastic soft material, shaped as shown in FIG. 3, fixed firmly on the upper portion of the elongate rod 1 with two screws 31, 31, and having a plurality of club holes 32 corresponding to the holes 21 of the support base 2 for the lower slender portions of golf clubs to fit therein, a long projection 33 and a short projection 34 extending outward from each hole 32, and a V-shaped notch 35 being formed by each pair of the long and the short projection 33 and 34 for receiving a slender lower portion of a golf club, which is forcibly pushed into each club hole 32 to secure the club on the rack.

The ball holder 4 is made of a kind of elastic soft material, having a plurality of round recesses 41 and being firmly fixed upright beside the bent section 13 of the elongate rod 1 so that golf balls can be held therein.

The carrying band 5 is adjustable in its length for carrying this rack, fixed on the elongate rod 1 with two screws 51, 52.

Figure 2:
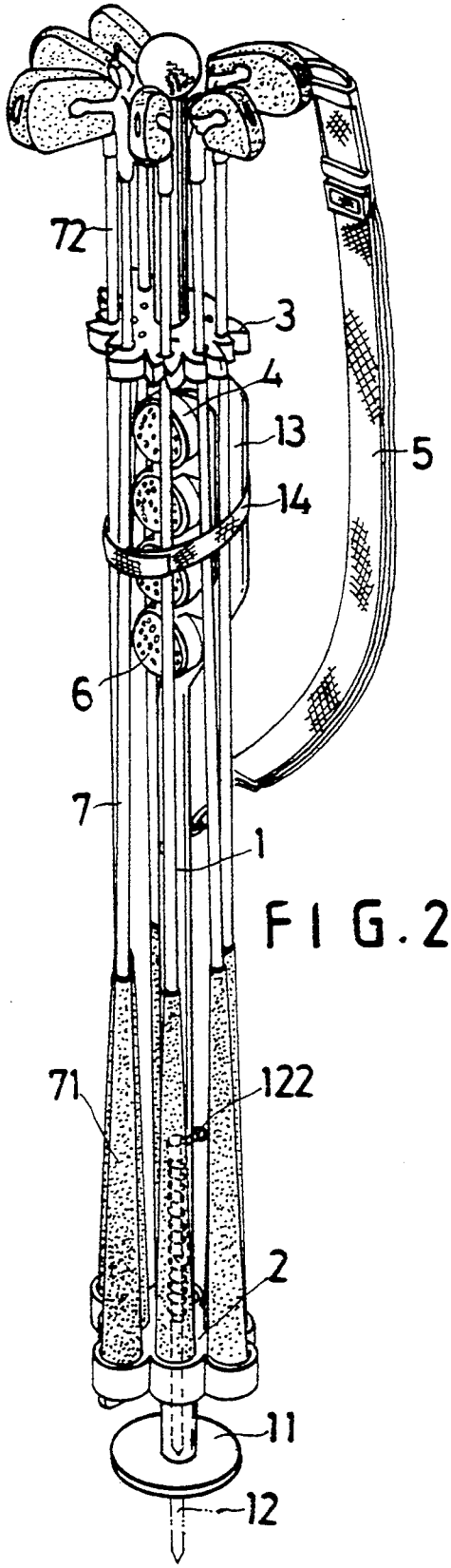
FIG. 2 is a perspective view of the golf club rack loaded with golf clubs and balls in the present invention.

In using, as shown in FIG. 2, golf balls 6 are placed in the recesses 41 of the ball holder 4, caught therein by elasticity of the recesses 41 without falling off the holder 4.

Then a golf club 7 is held downward, with the grip, the upper portion, inserted in one of the club holes 21 of the support base 2, and then the lower portion 72 of the club 7 is slightly pushed to expand the long and the short projection 33 and 34 to enter the club holes 32 via the notch 35 and be kept therein. After all the golf clubs are placed in the rack, the binding band 14 is bound around all the golf clubs 7, keeping them from falling off the rack, and the carrying band is used to shoulder it for carrying.

In handing this rack, the bolt 122 with the extensible rod 12 is pushed down and hooked at the hook-shaped bottom end 151 of the slot 15, preventing the extensible rod 12 from retreating, and forced to insert in the ground to stand up. Then the golf clubs in the rack can be taken out for use.

After use, the rack is pulled out of the ground, with the extensible rod 12 retreated back in the elongate rod 1. The rack can be shouldered with the carrying band 5, and also be carried by holding the bent section 13 of the elongate rod as well.

As can be understood from the above description, this golf club rack has advantages as follows.

1. Its whole weight is very light, convenient for carrying on a shoulder or with a hand.

2. It is a good bargain for users.

3. It can be directly inserted in the ground, handy for handling.

While the preferred embodiments of the invention have been described above, it will be recognized and understood that various modifications may be made therein and the appended claims are intended to cover all such modifications which may fall within the spirit and scope of the invention.

What is claimed is:

1. A golf club rack comprising:

an elongate rod having a bent section formed in an upper portion thereof, a disc secured to a portion of said elongate rod to rest on the ground, an extensible rod contained in a lower portion of said elongate rod, a coil spring mounted around said extensible rod to provide a biasing force to said extensible rod within said elongate rod subsequent to said extensible rod being pulled down out of the lower portion of said elongate rod, said extensible rod having a laterally extending bolt fixedly secured to a top section thereof for displacement of said extensible rod, said laterally extending bolt being displaced within a vertically directed lengthwise guide slot in said lower portion of said elongate rod to allow said extensible rod to be inserted in the ground to secure said golf club rack within the ground;

a support base having a plurality of club holes for the upper ends of golf club shafts to be inserted therein, and fixed firmly with said lower portion of said elongate rod above said disc;

a locating disc secured to said upper portion of said elongate rod adjacent said bent section having a plurality of club holes spaced around an outer circumference thereof, a plurality of long and short projections extending outward from each of said club holes and forming a notch between each said long and short projection for a slender lower portion of a golf club to slide into each said club hole;

a ball holder formed of an elastomeric material having a plurality of round recesses spaced apart each from the other in a straight line for insert of golf balls therein, said golf ball holder being located within said bent section of said elongate rod;

a carrying band fixed on said elongate rod with screws at both ends for carrying said rack on a shoulder.

2. The golf club rack as claimed in claim 1, wherein a binding band is provided on said bent section of said elongate rod for binding around golf clubs put in said rack.

3. The golf club rack as recited in claim 1, wherein said vertically directed lengthwise guide slot has a hook-shaped bottom end for said bolt to hook within to secure said extensible rod to said lower portion of said elongate rod with a portion of said extensible rod external to said elongate rod so that said extensible rod can be forcibly inserted in the ground to secure said rack within the ground when said extensible rod is pulled downwardly.

* * * * *